US008822395B2

(12) United States Patent
Ikeda et al.

(10) Patent No.: US 8,822,395 B2
(45) Date of Patent: Sep. 2, 2014

(54) REFRIGERATING-MACHINE OIL COMPOSITION AND COMPRESSOR AND REFRIGERATING APPARATUS BOTH EMPLOYING THE SAME

(75) Inventors: Harutomo Ikeda, Chiba (JP); Takayuki Kato, Aichi (JP); Manabu Sugiura, Aichi (JP); Masami Ohno, Aichi (JP); Shuichi Yasuda, Aichi (JP); Takahiro Sugioka, Aichi (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 678 days.

(21) Appl. No.: 11/913,075

(22) PCT Filed: Apr. 27, 2006

(86) PCT No.: PCT/JP2006/308877
§ 371 (c)(1),
(2), (4) Date: Apr. 25, 2008

(87) PCT Pub. No.: WO2006/120923
PCT Pub. Date: Nov. 16, 2006

(65) Prior Publication Data

US 2009/0082232 A1 Mar. 26, 2009

(30) Foreign Application Priority Data

May 11, 2005 (JP) ..... 2005-138890

(51) Int. Cl.

| | |
|---|---|
| ***C10M 133/06*** | (2006.01) |
| ***C10L 1/22*** | (2006.01) |
| ***F25B 43/02*** | (2006.01) |
| ***C10M 171/00*** | (2006.01) |
| ***F04B 39/02*** | (2006.01) |

(52) U.S. Cl.

CPC .... *F04B 39/0215* (2013.01); *C10M 2201/0663* (2013.01); *C10M 2213/0623* (2013.01); *C10N 2230/06* (2013.01); *C10M 2215/082* (2013.01); *C10M 2207/026* (2013.01); *C10N 2250/08* (2013.01); *C10M 2209/1033* (2013.01); *C10M 2201/0413* (2013.01); *C10M 2223/041* (2013.01); *C10M 2223/04* (2013.01); *C10M 2215/04* (2013.01); *C10M 171/008* (2013.01); *C10N 2240/30* (2013.01); *C10M 2217/0443* (2013.01); *C10N 2220/306* (2013.01); *C10M 2209/1055* (2013.01); *C10M 2223/043* (2013.01); *C10M 2215/08* (2013.01); *C10N 2220/022* (2013.01); *C10M 2207/042* (2013.01); *C10M 2209/1085* (2013.01)

USPC ..... 508/545; 508/100; 508/108; 508/175; 508/179; 508/436; 508/500; 508/551; 62/84; 62/193; 62/468; 62/498; 62/529

(58) Field of Classification Search

USPC ..... 508/579, 583, 539, 500, 100, 108, 175, 508/179, 436, 545, 551; 62/84, 193, 468, 62/498, 529

See application file for complete search history.

(56) References Cited

U.S. PATENT DOCUMENTS

| | | | | |
|---|---|---|---|---|
| 6,613,725 | B1 * | 9/2003 | Tazaki | 508/579 |
| 6,878,677 | B1 * | 4/2005 | Sakanoue et al. | 508/433 |
| 2001/0016564 | A1 * | 8/2001 | Konishi et al. | 508/371 |
| 2003/0111511 | A1 * | 6/2003 | Kanayama et al. | 228/101 |
| 2004/0154329 | A1 * | 8/2004 | Tadano et al. | 62/277 |
| 2005/0113265 | A1 * | 5/2005 | Yagishita | 508/188 |
| 2007/0155636 | A1 * | 7/2007 | Koishikawa | 508/547 |

FOREIGN PATENT DOCUMENTS

| | | | |
|---|---|---|---|
| EP | 0 890 743 | A2 | 1/1999 |
| EP | 1 132 457 | A2 | 9/2001 |
| EP | 1 167 495 | A1 | 1/2002 |
| JP | 07-247493 | | 9/1995 |
| JP | 11-013638 | | 1/1999 |
| JP | 2000-282076 | | 10/2000 |
| JP | 2001-255029 | | 9/2001 |
| JP | 2004-277787 | | 10/2004 |
| JP | 2005-89514 | | 4/2005 |
| WO | 03/057804 | | 7/2003 |

OTHER PUBLICATIONS

Extended European Search Report issued Aug. 21, 2012 in Patent Application No. 06732428.5.

"Evaluation of Various Compressor Lubricants for CO2—Refrigeration System", VDA Alternate Refrigerant Winter Meeting, XP-001223991, Feb. 18, 2004, pp. 1-30.

* cited by examiner

*Primary Examiner* — James Goloboy
*Assistant Examiner* — Latosha Hines
(74) *Attorney, Agent, or Firm* — Oblon, Spivak, McClelland, Maier & Neustadt, L.L.P.

(57) ABSTRACT

The present invention provides a refrigerating machine oil composition for use in a compressor for a refrigerator in which a sliding surface of at least a part of constitutional members of the compressor is coated with a lubrication film-forming composition containing a resin having a heat distortion temperature of 100° C. or higher as a binder, and a solid lubricant, wherein the refrigerating machine oil composition contains a base oil made of a polyoxyalkylene glycol having a kinematic viscosity of from 3 to 50 $mm^2/s$ as measured at 100° C., and a compound selected from the group consisting of amide compounds, amidated amino acid compounds and aliphatic amines having a specific structural formula which compound is contained in an amount of from 0.01 to 1% by mass on the basis of a total amount of the refrigerating machine oil composition, the refrigerating machine oil composition being capable of ensuring a good lubrication of sliding portions of the compressor upon starting operation of the compressor and during the operation; a compressor using the refrigerating machine oil composition; and a refrigerating apparatus including the compressor.

17 Claims, No Drawings

REFRIGERATING-MACHINE OIL COMPOSITION AND COMPRESSOR AND REFRIGERATING APPARATUS BOTH EMPLOYING THE SAME

TECHNICAL FIELD

The present invention relates to refrigerating machine oil compositions, and compressors and refrigerating apparatuses using the compositions, and more particularly to refrigerating machine oil compositions obtained by adding a specific compound to a base oil which are used for compressors having sliding portions coated with a lubrication film-forming composition containing a binder and a solid lubricant, and compressors and refrigerating apparatuses using the compositions.

BACKGROUND ART

Lubrication of respective sliding portions of a compressor used for a refrigerator is ensured by a lubricating oil having a good miscibility with a refrigerant contained in a cooling medium returned thereto. However, upon starting operation of the compressor, a certain period of time is required until the returned refrigerant in the compressor is fully supplied to the respective sliding portions, thereby causing such a problem that defective lubrication may occur at the sliding portions upon the starting. In order to compensate the defective lubrication upon starting operation of the compressor, there has been proposed the method of coating these sliding portions with a lubrication film-forming composition containing a solid lubricant (for example, refer to JP 7-247493A).

However, only such a coating lubrication film formed on a surface of the respective sliding portions fails to impart a fully satisfactory lubrication performance thereto upon the starting. Under some conditions, the coating lubrication film tends to suffer from abrasion, resulting in occurrence of seizing at the sliding portions.

Also, even under a steady operational condition of the compressor, a bearing surface pressure of the respective sliding portions thereof tends to be unsuitably increased depending upon kind of refrigerant used, for example, when using a carbon dioxide refrigerant, etc. As a result, even if the coating lubrication film is formed on the sliding portions, the coating layer tends to suffer from abrasion owing to the increased bearing surface pressure, thereby causing defective lubrication of the sliding portions.

DISCLOSURE OF THE INVENTION

The present invention has been made in view of the above conventional problems. An object of the present invention is to provide a refrigerating machine oil composition capable of ensuring good lubrication of sliding portions of a compressor for a refrigerator upon starting the operation thereof and during the operation, and a compressor and a refrigerating apparatus using the composition.

As a result of intensive and extensive researches for achieving the above object, the inventors have found that the conventional problems can be overcome by coating a sliding surface of at least a part of constitutional members of the compressor with a lubrication film-forming composition containing a binder and a solid lubricant, and using the thus coated structure in combination with a specific refrigerating machine oil composition. The present invention has been accomplished on the basis of the finding.

Thus, the present invention provides a refrigerating machine oil composition for use in a compressor for a refrigerator in which a sliding surface of at least a part of constitutional members of the compressor is coated with a lubrication film-forming composition containing a resin having a heat distortion temperature of 100° C. or higher as a binder, and a solid lubricant, said refrigerating machine oil composition comprising a base oil made of a polyoxyalkylene glycol having a kinematic viscosity of from 3 to 50 $mm^2/s$ as measured at 100° C., and at least one compound selected from the group consisting of those compounds represented by the following general formulae (1) to (3) which is contained in an amount of from 0.01 to 1% by mass on the basis of a total amount of the refrigerating machine oil composition:

$$R^1—CO—NR^2R^3 \quad (1)$$

wherein $R^1$ is an alkyl group having 6 to 30 carbon atoms or an alkenyl group having 6 to 30 carbon atoms; and $R^2$ and $R^3$ are each independently a hydrogen atom, a hydrocarbon group having 1 to 10 carbon atoms, a nitrogen-containing hydrocarbon group having 1 to 10 carbon atoms or an oxygen-containing hydrocarbon group having 1 to 10 carbon atoms;

$$R^4—CO—NR^5—R^6—COO—X \quad (2)$$

wherein $R^4$ is an alkyl group having 6 to 30 carbon atoms or an alkenyl group having 6 to 30 carbon atoms; $R^5$ is a hydrogen atom or an alkyl group having 1 to 4 carbon atoms; $R^6$ is an alkylene group having 1 to 8 carbon atoms; and X is a hydrogen atom, an alkali metal atom, a hydrocarbon group having 1 to 30 carbon atoms, a nitrogen-containing hydrocarbon group having 1 to 30 carbon atoms or an oxygen-containing hydrocarbon group having 1 to 30 carbon atoms; and $$R^7—NR^8R^9 \quad (3)$$

wherein $R^7$ is an alkyl group having 6 to 30 carbon atoms or an alkenyl group having 6 to 30 carbon atoms; and $R^8$ and $R^9$ are each independently a hydrogen atom or an alkyl group having 1 to 4 carbon atoms.

The refrigerating machine oil composition according to the present invention is capable of ensuring a good lubrication of sliding portions of a compressor for a refrigerator upon starting an operation thereof or and during the operation.

BEST MODE FOR CARRYING OUT THE INVENTION

The present invention is characterized by coating a sliding surface of at least a part of constitutional members of a compressor for a refrigerator with a lubrication film-forming composition containing a resin having a heat distortion temperature of 100° C. or higher as a binder, and a solid lubricant.

The "heat distortion temperature (HDT)" used herein means the temperature at which a plastic material undergoes deformation when heating the material at a constant rate while applying a constant load thereto. In the present invention, the heat distortion temperature is expressed by a temperature as measured by the "Heat Distortion Temperature Test" (1.8 MPa) according to ASTM D648.

In the present invention, it is required that a resin having a heat distortion temperature of 100° C. or higher is used as a binder. The heat distortion temperature of the binder is preferably 150° C. or higher, more preferably 200° C. or higher and still more preferably 250° C. or higher.

Specific examples of the binder include epoxy resins, phenol resins, fluororesins, unsaturated polyesters, polyacetals, polyimides, polyamide imides, polycarbonates, polysulfones, polyphenylene sulfides and polybenzazoles. Among these resins, from the viewpoint of a similar structure to those of compounds added to the refrigerating machine oil composition of the present invention, preferred are nitrogen-containing resins, and more preferred are polyimides, polyamide imides and polybenzazoles.

Examples of the polyimides include aromatic polyimides, polyether imides and modified products thereof. Examples of the polyamide imides include aromatic polyamide imides and modified products thereof. Examples of the suitable polybenzazoles include polybenzimidazole. These resins may be used alone or in the form of a mixture of any two or more thereof.

In the present invention, the above binder is contained in the lubrication film-forming composition, and the lubrication film-forming composition is coated onto a sliding surface of at least a part of constitutional members of the compressor. The content of the binder in the lubrication film-forming composition is preferably from 20 to 80% by mass on the basis of a total amount of the composition. When the content of the binder in the lubrication film-forming composition is 20% by mass or more, the below-mentioned solid lubricant can be firmly retained in the lubrication film obtained from the composition. When the content of the binder in the lubrication film-forming composition is 80% by mass or less, the resultant composition exhibits a sufficient lubricating property. From the above viewpoints, the content of the binder in the lubrication film-forming composition is more preferably in the range of from 30 to 70% by mass.

The solid lubricant is not particularly limited as long as it can exhibit a good lubricating property in a solid state. Specific examples of the solid lubricant include graphite, molybdenum disulfide, tungsten sulfide, fluororesins and boron nitride. Among these solid lubricants, preferred are molybdenum disulfide and fluororesins. These solid lubricants may be used alone or in the form of a mixture of any two or more thereof.

The average particle size of the solid lubricant in the resultant lubrication film is not particularly limited, and is preferably from 1 to 100 μm in view of forming a dense lubrication film.

The content of the solid lubricant in the lubrication film-forming composition is preferably from 20 to 80 parts by mass on the basis of 100 parts by mass of the binder resin. When the content of the solid lubricant is 20 parts by mass or more, the resultant composition exhibits a sufficient lubricating property. When the content of the solid lubricant is 80 parts by mass or less, the solid lubricant is free from deteriorated retention in the obtained lubrication film owing to a less content of the binder, and further can be prevented from suffering from abrasion and peeling. From the above viewpoints, the content of solid lubricant in the lubrication film-forming composition is more preferably in the range of from 30 to 70 parts by mass on the basis of 100 parts by mass of the binder resin.

Also, the lubrication film-forming composition preferably contains a film-forming assistant. Examples of the suitable film-forming assistant include epoxy group-containing compounds and silane coupling agents. The film-forming assistant is capable of improving retention of the solid lubricant in the lubrication film.

The content of the film-forming assistant based on the binder resin is preferably controlled such that a mass ratio of the binder resin to the film-forming assistant is in the range of from 99:1 to 70:30.

The lubrication film-forming composition may also contain various known additives, if required. Examples of the additives include extreme pressure agents, e.g., phosphoric acid esters such as tricresyl phosphate (TCP) and phosphorous acid esters such as trisnonylphenyl phosphite; antioxidants such as phenol-based compounds and amine-based compounds; stabilizers such as phenyl glycidyl ether, cyclohexene oxide and epoxidated soybean oil; and copper deactivators such as benzotriazole and derivatives thereof. These additives may be respectively blended in an appropriate amount in the lubrication film-forming composition. In addition to these additives, the lubrication film-forming composition may also contain, if required, other additives such as load-resisting additives, chlorine scavengers, detergent dispersants, viscosity index improvers, oiliness agents, rust preventives, corrosion inhibitors and pour point depressants. The content of these additives in the lubrication film-forming composition is usually from 0.5 to 10% by mass.

The thickness of the lubrication film formed from the above lubrication film-forming composition is not particularly limited as long as the effects of the present invention can be exhibited, and is preferably in the range of from 2 to 50 μm. When the thickness of the lubrication film is 2 μm or more, the resultant lubrication film can ensure a sufficient lubricating property. When the thickness of the lubrication film is 50 μm or less, the resultant lubrication film can maintain a good fatigue resistance. From the above viewpoints, the thickness of the lubrication film is more preferably in the range of from 4 to 25 μm.

The lubrication film-forming composition is applied onto a sliding surface of at least a part of constitutional members of the compressor. The method of coating the sliding surface with the lubrication film-forming composition is not particularly limited. For example, there may be used the method of dispersing the solid lubricant in an organic solvent solution of the binder to prepare a lubrication film-forming composition, and then directly applying the thus prepared composition onto the sliding portions, the method of immersing the sliding portions in the lubrication film-forming composition, or the like. The lubrication film-forming composition applied onto the sliding portions is formed into a lubrication film by removing the solvent therefrom by the suitable methods such as drying.

The refrigerating machine oil composition of the present invention contains, as a base oil, a polyoxyalkylene glycol having a kinematic viscosity of from 3 to 50 $mm^2/s$ as measured at 100° C. More specifically, the polyoxyalkylene glycol is preferably represented by the following general formula (4):

$$R^{10}—O-(AO)_m—R^{11} \quad (4)$$

In the general formula (4), $R^{10}$ and $R^{11}$ are each independently a hydrogen atom or a hydrocarbon group having 1 to 8 carbon atoms, and both of $R^{10}$ and $R^{11}$ are preferably a methyl group. $R^{10}$ and $R^{11}$ may be the same or different. Next, A is an alkylene group having 2 to 8 carbon atoms and, in particular, is preferably an alkylene group having 3 carbon atoms. The suffix m is an integer of 1 or more, and when m is 2 or more, a plurality of A groups may be the same or different. Meanwhile, when a plurality of the A groups are present, the AO groups may be either random-copolymerized or block-copolymerized.

The refrigerating machine oil composition of the present invention contains, in addition to the above polyoxyalkylene glycol, at least one compound selected from the group consisting of those compounds represented by the following general formulae (1) to (3).

$$R^1—CO—NR^2R^3 \quad (1)$$

In the general formula (1), $R^1$ is an alkyl group having 6 to 30 carbon atoms or an alkenyl group having 6 to 30 carbon atoms. These alkyl groups and alkenyl groups may be either linear, branched or cyclic. Also, $R^2$ and $R^3$ are each independently a hydrogen atom, a hydrocarbon group having 1 to 10 carbon atoms, a nitrogen-containing hydrocarbon group having 1 to 10 carbon atoms or an oxygen-containing hydrocarbon group having 1 to 10 carbon atoms. These hydrocarbon groups may be either linear, branched or cyclic and may also contain an aromatic ring, an unsaturated bond, etc. In addition, $R^2$ and $R^3$ may be the same or different.

Examples of the compounds represented by the general formula (1) include amides produced by the reaction between a fatty acid and an amine. Specific examples of the fatty acid used in the reaction include stearic acid, isostearic acid, oleic acid, ricinolic acid, lauric acid and coconut oil fatty acids. Among these fatty acids, especially preferred are stearic acid and oleic acid. Specific examples of the amine used in the reaction include tetraethylenepentamine, ammonia, diethanol amine and diethylaminoethylamine. Among these amines, especially preferred is diethyl amino ethyl amine.

$$R^4—CO—NR^5—R^6—COO—X \quad (2)$$

In the general formula (2), $R^4$ is an alkyl group having 6 to 30 carbon atoms or an alkenyl group having 6 to 30 carbon atoms, i.e., is the same as $R^1$ of the general formula (1). Also, $R^5$ is a hydrogen atom or an alkyl group having 1 to 4 carbon atoms, $R^6$ is an alkylene group having 1 to 8 carbon atoms, and X is a hydrogen atom, an alkali metal atom, a hydrocarbon group having 1 to 30 carbon atoms, a nitrogen-containing hydrocarbon group having 1 to 30 carbon atoms or an oxygen-containing hydrocarbon group having 1 to 30 carbon atoms. Meanwhile, these hydrocarbon groups may be either linear, branched or cyclic, and may contain an aromatic ring, an unsaturated bond, etc.

The compounds represented by the general formula (2) may be produced by the reaction between a fatty acid and an amino acid, an amino acid salt or an amino acid ester. Examples of the fatty acid include stearic acid, isostearic acid, oleic acid, ricinolic acid, lauric acid and coconut oil fatty acids. Among these fatty acids, in view of a good solubility, preferred are stearic acid, isostearic acid and oleic acid, and in view of a good availability, preferred are oleic acid, lauric acid and coconut oil fatty acids. Specific examples of the amino acid include sarcosine (N-methyl glycine), glycine and glutamic acid. Specific examples of the amino acid salt include potassium salts, sodium salts, etc., of the above amino acids. Specific examples of the amino acid ester include amino acid isopropyl esters, amino acid 2-hydroxyhexadecyl esters, amino acid 2-hydroxytetradecyl esters and amino acid 2-hydroxydodecyl esters. Among these compounds, in view of a good availability and an easiness of synthesis, especially preferred are amino acid 2-hydroxyfatty esters such as amino acid 2-hydroxyhexadecyl esters, amino acid 2-hydroxytetradecyl esters and amino acid 2-hydroxydodecyl esters.

$$R^7—NR^8R^9 \quad (3)$$

In the general formula (3), $R^7$ is an alkyl group having 6 to 30 carbon atoms or an alkenyl group having 6 to 30 carbon atoms, i.e., is the same as $R^1$ of the general formula (1). $R^8$ and $R^9$ are each independently a hydrogen atom or an alkyl group having 1 to 4 carbon atoms, and may be the same or different.

The compounds represented by the general formula (3) are aliphatic amines. Specific examples of the compounds represented by the general formula (3) include oleyl amine and diisopropyl amine.

The refrigerating machine oil composition of the present invention may also contain various known additives, if required. The refrigerating machine oil composition of the present invention preferably contains a phosphorus-based extreme pressure agent. Examples of the preferred phosphorus-based extreme pressure agent include an acid phosphoric ester compound and/or an amine salt thereof, and an acid phosphorous ester compound and/or an amine salt thereof. Among these compounds, especially preferred are the acid phosphoric ester compound and/or the amine salt thereof. Specific examples of the acid phosphoric ester compound and/or the amine salt thereof include di-n-butyl phosphate, and a dodecylamine salt, a n-octylamine salt and a cyclohexylamine salt of di-n-butyl phosphate; and di-2-ethylhexyl phosphate, and a n-octylamine salt, a n-butylamine salt, a n-ethylamine salt and a cyclohexylamine salt of di-2-ethylhexyl phosphate. Specific examples of the acid phosphorous ester compound and/or the amine salt thereof include dioleyl hydrogen phosphite, and a dodecylamine salt, a n-octylamine salt and a cyclohexylamine salt of dioleyl hydrogen phosphite; and dilauryl hydrogen phosphite, and a dodecylamine salt, a n-octylamine salt and a cyclohexylamine salt of dilauryl hydrogen phosphite.

In addition, the refrigerating machine oil composition of the present invention preferably contains an antioxidant or an acid scavenger.

Examples of the antioxidant include phenol-based antioxidants and amine-based antioxidants. Specific examples of the phenol-based antioxidants include 2,6-di-tert-butyl-4-methyl phenol (DBPC), 2,4-dimethyl-6-tert-butyl phenol and 2,6-di-tert-butyl phenol. Specific examples of the amine-based antioxidants include N,N'-diisopropyl-p-phenylene diamine, N,N'-di-sec-butyl-p-phenylene diamine and α-naphthyl amine.

Examples of the acid scavenger include glycidyl ether group-containing compounds, epoxidated fatty acid monoesters, epoxidated soybean oil, epoxycycloalkyl group-containing compounds, α-olefin epoxides and glycidyl ester group-containing compounds.

In addition, the refrigerating machine oil composition of the present invention may also contain other known additives used in the conventional lubricating oils, for example, extreme pressure agents other than those described above. Examples of the other extreme pressure agents include organosulfur compounds such as monosulfides, polysulfides, sulfoxides, sulfones, thiosulfinates, sulfurized fats and oils, thiocarbonates, thiophenes, thiazoles and methanesulfonic acid esters; thiophosphoric ester compounds such as thiophosphoric triesters; ester-based compounds such as higher fatty acid esters, hydroxyaryl fatty acid esters, polyhydric alcohol esters and acrylic esters; organochlorine-based compounds such as chlorinated hydrocarbons and chlorinated carboxylic acid derivatives; organofluorine-based compounds such as fluorinated aliphatic carboxylic acids, fluorinated ethylene resins, fluorinated alkyl polysiloxanes and fluorinated graphites; alcohol-based compounds such as higher alcohols; and metal compounds such as naphthenic acid salts (such as lead naphthenate), fatty acid salts (such as fatty acid lead salts), thiophosphoric acid salts (such as zinc dialkyldithiophosphates), thiocarbamic acid salts, organomolybdenum compounds, organotin compounds, organogermanium compounds and boric acid esters.

Further, the refrigerating machine oil composition of the present invention may also be appropriately blended with stabilizers such as phenyl glycidyl ethers, cyclohexene oxides and epoxidated soybean oils; and copper deactivators such as benzotriazole and derivatives thereof. Furthermore, other additives such as load-resisting additives, chlorine scavengers, detergent dispersants, viscosity index improvers, oiliness agents, rust preventives, corrosion inhibitors and pour point depressants may be added to the refrigerating machine oil composition of the present invention, if required. The content of these additives in the refrigerating machine oil composition is usually from 0.5 to 10% by mass.

The refrigerating machine oil composition of the present invention can be suitably used for various refrigerants such as, for example, carbon dioxide-based refrigerants, hydrocarbon-based refrigerants, ammonia-based refrigerants and flon-based refrigerants. In particular, among these refrigerants, the composition of the present invention can be more suitably used for the carbon dioxide-based refrigerants.

Next, the compressor of the present invention is characterized in that the above refrigerating machine oil composition is used therein, and a sliding surface of a constitutional member of the compressor is coated with a lubrication film-forming composition containing a nitrogen-containing resin as a binder and at least one compound selected from the group consisting of molybdenum disulfide and fluororesins. Examples of the constitutional member of the compressor include a swash plate, a piston and a shoe in the case of a swash plate-type compressor. By coating the sliding surface of the respective members with the above lubrication film-forming composition and further using the above refrigerating machine oil composition in the compressor, a good lubrication of the sling surface can be ensured.

The swash plate-type compressor usually includes a pair of cylinder blocks butt-joined together in a front-to-back direction so as to form a swash plate chamber communicating with a suction port for a refrigerant returned thereto, at a joint portion therebetween. Both outside ends of the cylinder blocks are closed by front and rear housings, respectively, through a valve plate. The housings are each provided therein with a suction chamber and a discharge chamber. The discharge chamber disposed in the rear housing is communicated with a discharge port for discharging the refrigerant therefrom. The cylinder blocks have a common center axis hole into which a drive shaft is inserted and supported. A swash plate is fixed onto the drive shaft and rotatably accommodated within the swash plate chamber. Also, the cylinder blocks have plural pairs of bores arranged in the front-to-back direction and disposed in parallel with each other around the drive shaft. A double-ended piston anchored to the swash plate through a shoe is inserted into each bore so as to be linearly movable therein. The valve plates are respectively formed with a suction port communicating with the suction chamber of each housing through a suction valve between the respective bores, and formed with a discharge port communicating with the discharge chamber of each housing through a discharge valve between the respective bores. The swash plate chamber and the suction chamber of each housing are communicated with each other through a suction passage formed in each cylinder block, and the discharge chamber formed in the front housing is communicated with the discharge chamber formed in the rear housing through a discharge passage formed in the cylinder blocks.

In the above swash plate-type compressor, the returned refrigerant is introduced from the refrigerating circuit into the swash plate chamber through the suction port, and the returned refrigerant in the swash plate chamber is then introduced into the front and rear suction chambers through the suction passage. When the drive shaft is rotated, the respective pistons connected thereto through the swash plate are caused to linearly move in each bore, so that the returned refrigerant filled within the respective suction chambers is sucked through the respective suction ports into the bores which are now expanding their volumes. Thereafter, the refrigerant compressed in the bores which are now reducing their volumes is discharged through the respective discharge ports into the front and rear discharge chambers. The compressed refrigerant filled in the front discharge chamber is collected into the rear discharge chamber through the discharge passage. Then, the compressed refrigerant collected in the rear discharge chamber is discharged into the refrigerating circuit through the discharge port and circulated again through the refrigerating circuit.

Also, the present invention involves such a refrigerating apparatus in which carbon dioxide as a refrigerant is circulated through a refrigerating circuit constituted from the above compressor, a radiator, an expansion mechanism and an evaporator.

EXAMPLES

The present invention will be described in more detail by referring to the following examples. However, it should be noted that these examples are only illustrative and not intended to limit the invention thereto.

The refrigerating machine oil composition was evaluated by a reciprocating friction/abrasion test (Bauden Leben Test). Specifically, the evaluation was made by subjecting a sliding member to the above test to measure a friction coefficient thereof after 5, 100 and 200 reciprocating strokes. The testing conditions are as follows.

Ball (Sphere): SUJ2; 3/16 inch

Plate: A cut piece of a swash plate available from Toyota Industries Corporation was used. More specifically, the swash plate was worked as follows. That is, a FCD700 base material for the plate was coated with a lubrication film-forming composition containing a polyamide imide as a binder and a solid lubricant composed of molybdenum disulfide, graphite and polytetrafluoroethylene (PTFE) to form a coating film having a thickness of 30 μm thereon, and then processed such that the thickness of the coating film was from 10 to 20 μm, and the surface roughness Rz (10 point-mean roughness) thereof was 3.2 μm or less.

Load applied: 0.5 kgf

Velocity: 20 mm/s

Stroke: 10 mm

Testing temperature: room temperature

Atmosphere: air

Examples 1 to 26 and Comparative Example 1

A polyalkylene glycol containing propyleneoxide repeating units and methyl groups bonded to both terminal ends thereof and having a viscosity of 10 $mm^2/s$ as measured at 100° C. was used as a base oil, and the additives as shown in Table 1 below as well as 0.5% by mass of 2,6-di-tert-butyl-p-cresol (DBPC) as an antioxidant, 1.5% by mass of α-olefin epoxide as an acid scavenger and 0.9% by mass of tricresyl phosphate (TCP) were added to the base oil to prepare a refrigerating machine oil composition. The thus prepared composition was evaluated according to the above method. The results are shown in Table 1.

Meanwhile, the numeral "0.115" as a friction coefficient appearing in Table 1 represents the friction coefficient measured at the time at which the coating layer was worn so that the plate (FCD700 as the base material) and the ball (SUJ2) were contacted with each other.

TABLE 1

| | Additives (mass %) | |
|---|---|---|
| | Compound of general formula (1) | Compound of general formula (2) |
| Example 1 | Isostearic acid TEPA amide (0.2%) | |
| Example 2 | Oleamide (0.2%) | |
| Example 3 | Ricinolamide (1.0%) | |
| Example 4 | | Oleyl sarcosine (0.3%) |
| Example 5 | | |
| Example 6 | | Oleyl sarcosine (0.3%) |
| Example 7 | | Oleyl sarcosine (0.3%) |
| Example 8 | | K salt of oleyl sarcosine (0.05%) |
| Example 9 | | Na salt of lauroyl sarcosine (0.03%) |
| Example 10 | | Na salt of coconut oil fatty acid glycine (0.03%) |
| Example 11 | | K salt of coconut oil fatty acid glycine (0.03%) |
| Example 12 | | Di-K salt of coconut oil fatty acid/glutamic acid (0.03%) |
| Example 13 | | Oleyl sarcosine (0.3%) |
| Example 14 | | Oleyl sarcosine (0.3%) |
| Example 15 | | K salt of oleyl sarcosine (0.05%) |
| Example 16 | | N-lauroyl glycine isopropyl ester (1.0%) |
| Example 17 | Oleic acid diethanol amide (1.0%) | |
| Example 18 | Oleic acid diethanol amide (1.0%) | |
| Example 19 | Oleic acid diethanol amide (1.0%) | |
| Example 20 | Stearic acid diethylaminoethyl amide (0.2%) | |
| Example 21 | Stearic acid diethylaminoethyl amide (0.2%) | |
| Example 22 | Stearic acid diethylaminoethyl amide (0.2%) | |
| Example 23 | Stearic acid diethylaminoethyl amide (0.2%) | |
| Example 24 | | Oleoyl sarcosine (2-hydroxyhexadecyl) ester (0.5%) |
| Example 25 | | Oleoyl sarcosine (2-hydroxytetradecyl) ester (0.5%) |
| Example 26 | | Oleoyl sarcosine (2-hydroxydodecyl) ester (0.5%) |
| Comparative Example 1 | | |

| | Additives (mass %) | |
|---|---|---|
| | Compound of general formula (3) | Other additives |
| Example 1 | | |
| Example 2 | | |
| Example 3 | | |
| Example 4 | | |
| Example 5 | Oleyl amine (0.1%) | |
| Example 6 | Oleyl amine (0.2%) | |
| Example 7 | Diisopropyl amine (0.1%) | |
| Example 8 | | |
| Example 9 | | |
| Example 10 | | |
| Example 11 | | |
| Example 12 | | |
| Example 13 | | Acid phosphoric ester amine salt (0.02%) |

TABLE 1-continued

| | | |
|---|---|---|
| Example 14 | | Acid phosphoric ester amine salt (0.05%) |
| Example 15 | | Acid phosphoric ester amine salt (0.02%) |
| Example 16 | | |
| Example 17 | | |
| Example 18 | | Dioleyl hydrogen phosphite (1.0%) |
| Example 19 | | Acid phosphoric ester amine salt (0.05%) |
| Example 20 | | |
| Example 21 | | Dioleyl hydrogen phosphite (1.0%) |
| Example 22 | | Acid phosphoric ester amine salt (0.05%) |
| Example 23 | | Acid phosphoric ester amine salt (0.03%) |
| Example 24 | | |
| Example 25 | | |
| Example 26 | | |
| Comparative Example 1 | | |

| | Friction coefficient | | |
|---|---|---|---|
| | After 5 reciprocating strokes | After 100 reciprocating strokes | After 200 reciprocating strokes |
| Example 1 | 0.059 | 0.079 | 0.096 |
| Example 2 | 0.054 | 0.082 | 0.098 |
| Example 3 | 0.049 | 0.077 | 0.092 |
| Example 4 | 0.059 | 0.076 | 0.092 |
| Example 5 | 0.056 | 0.088 | 0.097 |
| Example 6 | 0.044 | 0.076 | 0.079 |
| Example 7 | 0.047 | 0.073 | 0.097 |
| Example 8 | 0.044 | 0.080 | 0.102 |
| Example 9 | 0.054 | 0.088 | 0.100 |
| Example 10 | 0.053 | 0.071 | 0.083 |
| Example 11 | 0.052 | 0.075 | 0.083 |
| Example 12 | 0.057 | 0.073 | 0.085 |
| Example 13 | 0.057 | 0.069 | 0.091 |
| Example 14 | 0.052 | 0.078 | 0.104 |
| Example 15 | 0.053 | 0.072 | 0.080 |
| Example 16 | 0.057 | 0.074 | 0.097 |
| Example 17 | 0.055 | 0.084 | 0.093 |
| Example 18 | 0.057 | 0.063 | 0.078 |
| Example 19 | 0.060 | 0.071 | 0.080 |
| Example 20 | 0.056 | 0.074 | 0.090 |
| Example 21 | 0.058 | 0.066 | 0.074 |
| Example 22 | 0.062 | 0.073 | 0.082 |
| Example 23 | 0.059 | 0.074 | 0.086 |
| Example 24 | 0.053 | 0.080 | 0.104 |
| Example 25 | 0.053 | 0.080 | 0.104 |
| Example 26 | 0.053 | 0.080 | 0.104 |
| Comparative Example 1 | 0.082 | 0.115 | 0.115 |

INDUSTRIAL APPLICABILITY

The refrigerating machine oil composition of the present invention as well as a compressor and a refrigerating apparatus using the composition can ensure good lubrication of sliding portions upon starting operation of a compressor for a refrigerator and during the operation.

The invention claimed is:

1. A compressor containing a refrigerating machine oil comprising:

a base oil made of a polyoxyalkylene glycol having a kinematic viscosity of from 3 to 50 $mm^2/s$ as measured at 100° C., and at least one compound selected from the group consisting of a compound of formula (1) and a compound of formula (2) which is contained in an amount of from 0.01 to 1% by mass on the basis of a total amount of the refrigerating machine oil;

wherein compounds of formulas (1) and (2) are described below:

$$R^1—CO—NR^2R^3 \quad (1),$$

wherein $R^1$ is an alkyl group having 6 to 30 carbon atoms or an alkenyl group having 6 to 30 carbon atoms; and $R^2$ and $R^3$ are each independently a hydrogen atom, a hydrocarbon group having 1 to 10 carbon atoms, a nitrogen-containing hydrocarbon group having 1 to 10 carbon atoms or an oxygen-containing hydrocarbon group having 1 to 10 carbon atoms; and $$R^4—CO—NR^5—R^6—COO—X \quad (2)$$

wherein $R^4$ is an alkyl group having 6 to 30 carbon atoms or an alkenyl group having 6 to 30 carbon atoms; $R^5$ is a hydrogen atom or an alkyl group having 1 to 4 carbon atoms; $R^6$ is an alkylene group having 1 to 8 carbon atoms; and X is a hydrogen atom, an alkali metal atom, a hydrocarbon group having 1 to 30 carbon atoms, a nitrogen-containing hydrocarbon group having 1 to 30 carbon atoms or an oxygen-containing hydrocarbon group having 1 to 30 carbon atoms;

wherein a sliding surface of at least part of constitutional member(s) of the compressor is coated with a lubrication film containing a nitrogen-containing resin as a binder and a solid lubricant.

2. The compressor according to claim 1, wherein the binder in the lubrication film is a resin containing at least one compound selected from the group consisting of polyamide imides, polyimides and polybenzazoles.

3. The compressor according to claim 1, wherein the compressor is of a type in which carbon dioxide as a refrigerant is compressed.

4. The compressor according to claim 1, wherein the constitutional member of the compressor is at least one member selected from the group consisting of a swash plate, a piston and a shoe.

5. The compressor of claim 1, wherein said at least one compound selected from the group consisting of a compound of formula (1) and a compound of formula (2) is a compound of formula (2).

6. The compressor of claim 5, wherein the compound of formula (2) is oleyl sarcosine or a salt thereof.

7. The compressor of claim 1, wherein said constitutional member is at least one swash plate, piston or shoe.

8. The compressor of claim 1, wherein said nitrogen-containing resin as a binder comprises a polyimide, polyamide imide, or polybenzazole.

9. The compressor of claim 1, wherein said solid lubricant comprises graphite, molybdenum disulfide, tungsten sulfide, fluororesin, or boron nitride.

10. The compressor of claim 1, wherein a sliding surface of at least part of constitutional member(s) of the compressor is coated with a lubrication film containing a nitrogen-containing resin as a binder ranging in thickness from 2 μm to 50 μm and a solid lubricant.

11. A refrigerating apparatus comprising a refrigerating circuit constituted from a compressor, a radiator, an expansion mechanism and an evaporator, in which carbon dioxide as a refrigerant is circulated through the refrigerating circuit, wherein the compressor contains a refrigerating oil composition comprising a base oil made of a polyoxyalkylene glycol having a kinematic viscosity of from 3 to 50 $mm^2/s$ as measured at 100° C., and at least one compound selected from the group consisting of a compound of formula (1) and a compound of formula (2) which is contained in an amount of from 0.01 to 1% by mass on the basis of a total amount of the refrigerating machine oil composition; wherein compounds of formulas (1) and (2) are described below:

$$R^1—CO—NR^2R^3 \quad (1)$$

wherein $R^1$ is an alkyl group having 6 to 30 carbon atoms or an alkenyl group having 6 to 30 carbon atoms; and $R^2$ and $R^3$ are each independently a hydrogen atom, a hydrocarbon group having 1 to 10 carbon atoms, a nitrogen-containing hydrocarbon group having 1 to 10 carbon atoms or an oxygen-containing hydrocarbon group having 1 to 10 carbon atoms;

$$R^4—CO—NR^5—R^6—COO—X \quad (2)$$

wherein $R^4$ is an alkyl group having 6 to 30 carbon atoms or an alkenyl group having 6 to 30 carbon atoms; $R^5$ is a hydrogen atom or an alkyl group having 1 to 4 carbon atoms; $R^6$ is an alkylene group having 1 to 8 carbon atoms; and X is a hydrogen atom, an alkali metal atom, a hydrocarbon group having 1 to 30 carbon atoms, a nitrogen-containing hydrocarbon group having 1 to 30 carbon atoms or an oxygen-containing hydrocarbon group having 1 to 30 carbon atoms; and wherein a sliding portion of at least part of constitutional member(s) of the compressor is coated with a lubrication film containing a nitrogen-containing resin as a binder and a solid lubricant.

12. The refrigerating apparatus of claim 11, wherein said at least one compound selected from the group consisting of a compound of formula (1) and a compound of formula (2) is a compound of formula (2).

13. The refrigerating apparatus of claim 12, wherein the compound of formula (2) is oleyl sarcosine or a salt thereof.

14. The refrigerating apparatus of claim 11, wherein said constitutional member is at least one swash plate, piston or shoe.

15. The refrigerating apparatus of claim 11, wherein said nitrogen-containing resin as a binder comprises a polyimide, polyamide imide, or polybenzazole.

16. The refrigerating apparatus of claim 11, wherein said solid lubricant comprises graphite, molybdenum disulfide, tungsten sulfide, fluororesin, or boron nitride.

17. The refrigerating apparatus of claim 11, wherein a sliding surface of at least part of constitutional member(s) of the compressor is coated with a lubrication film containing a nitrogen-containing resin as a binder ranging in thickness from 2 μm to 50 μm and a solid lubricant.

* * * * *